US007100903B1

(12) United States Patent
Wilson

(10) Patent No.: US 7,100,903 B1
(45) Date of Patent: Sep. 5, 2006

(54) IMPACT BARRIER SYSTEM

(76) Inventor: Harold E. Wilson, 13816 Shaffer Dr., Vance, AL (US) 35490

( * ) Notice: Subject to any disclaimer, the term of this patent is extended or adjusted under 35 U.S.C. 154(b) by 53 days.

(21) Appl. No.: 10/944,530

(22) Filed: Sep. 17, 2004

Related U.S. Application Data

(60) Provisional application No. 60/504,541, filed on Sep. 19, 2003.

(51) Int. Cl.
*A01K 3/00* (2006.01)

(52) U.S. Cl. ..... 256/13.1; 404/6; 404/9; 404/10

(58) Field of Classification Search ..... 256/13.1; 404/6, 7, 9, 10, 12
See application file for complete search history.

(56) References Cited

U.S. PATENT DOCUMENTS 2,974,934 A 3/1961 White
6,309,140 B1 10/2001 Kiedaisch et al.
6,340,268 B1 1/2002 Alberson et al.
6,439,801 B1 * 8/2002 Galiana et al. ..... 404/6
6,533,495 B1 3/2003 Williams et al.
6,551,010 B1 4/2003 Kiedaisch et al.
6,554,530 B1 * 4/2003 Moore ..... 404/6
6,905,283 B1 * 6/2005 Salyer, Sr. ..... 404/10
2003/0133749 A1 7/2003 Russell

* cited by examiner

*Primary Examiner*—Daniel P. Stodola
*Assistant Examiner*—Nahid Amiri
(74) *Attorney, Agent, or Firm*—Kenneth M. Bush; Bush IP Law Group, LLC

(57) ABSTRACT

An impact barrier system comprising a plurality of bow-shaped panels attached to a retaining wall in overlapping side-by-side relationship that, together with the configuration of the panels, provides a plurality of impact absorbing features that work together to absorb the impact of a vehicle and transfer the force of the impact across multiple panels. The panels are resilient and predisposed to assume their original configuration after the impact.

11 Claims, 3 Drawing Sheets

IMPACT BARRIER SYSTEM

RELATED PATENT APPLICATION

This nonprovisional patent application claims priority to Provisional Patent Application No. 60/504,541, filed on Sep. 19, 2003, and incorporated herein by reference.

FIELD OF THE INVENTION

The present invention is related to an impact barrier system for installation along highways, racetracks, and the like to reduce the likelihood of injury or death during a high speed impact.

BACKGROUND OF THE INVENTION

Roads, including both highways and racetracks, are often bounded along their edges by rigid barrier walls. Such barrier walls protect both structures and people adjacent the road by preventing vehicles from accidentally leaving the road or adjacent shoulders. However, such rigid barriers or barrier walls, alone, do not effectively absorb energy during collision with a vehicle. As a result, collisions of the vehicle and the barrier wall often result in great damage to the vehicle and personal injury to the vehicle's driver and passengers. To further protect the vehicle and its driver and passengers many barrier walls now include energy absorbing systems which typically include compressible materials adjacent to the perimeter of the road. Such compressible materials do not effectively attenuate the G-forces created during a crash or collision with a vehicle. In many situations, other vehicles following the first crash will lose control attempting to avoid the first accident which results in second-vehicle crashes. However, due to damage to the compressible materials from the first vehicle crash, these compressible materials are ineffective against further impacts or vehicles crashes. In addition, reconstruction and replacement of the compressible materials is time consuming and expensive.

Compressible over-lapping fender-like devices have been disclosed which will absorb the energy of impact during a collision. These devices are L-, T-, or Z-shaped fenders which become compressed during collision. However, once compressed, these devices remain compressed and must be replaced.

SUMMARY OF THE INVENTION

The present invention is an impact barrier system comprising a plurality of bow-shaped panels attached to a retaining wall in overlapping side-by-side relationship that, together with the configuration of the panels, provides a plurality of impact absorbing features that work together to absorb the impact of a vehicle and transfer the force of the impact across multiple panels. The panels are resilient and predisposed to assume their original configuration, which has the effect of pushing the vehicle away from the retaining wall after the impact, thus reducing the likelihood of occupants being trapped in the vehicle after impact. Further, occupants of the vehicle can exit the vehicle and position themselves between a panel and the retaining wall after the impact to protect themselves from fire or explosion of the vehicle.

These and other advantages of the invention will become apparent from the following detailed description of the preferred embodiment of the invention.

BRIEF DESCRIPTION OF THE DRAWINGS

An impact barrier system embodying the features of the present invention is depicted in the accompanying drawings which form a portion of this disclosure and wherein.

DETAILED DESCRIPTION OF THE PREFERRED EMBODIMENTS

Figure 1:
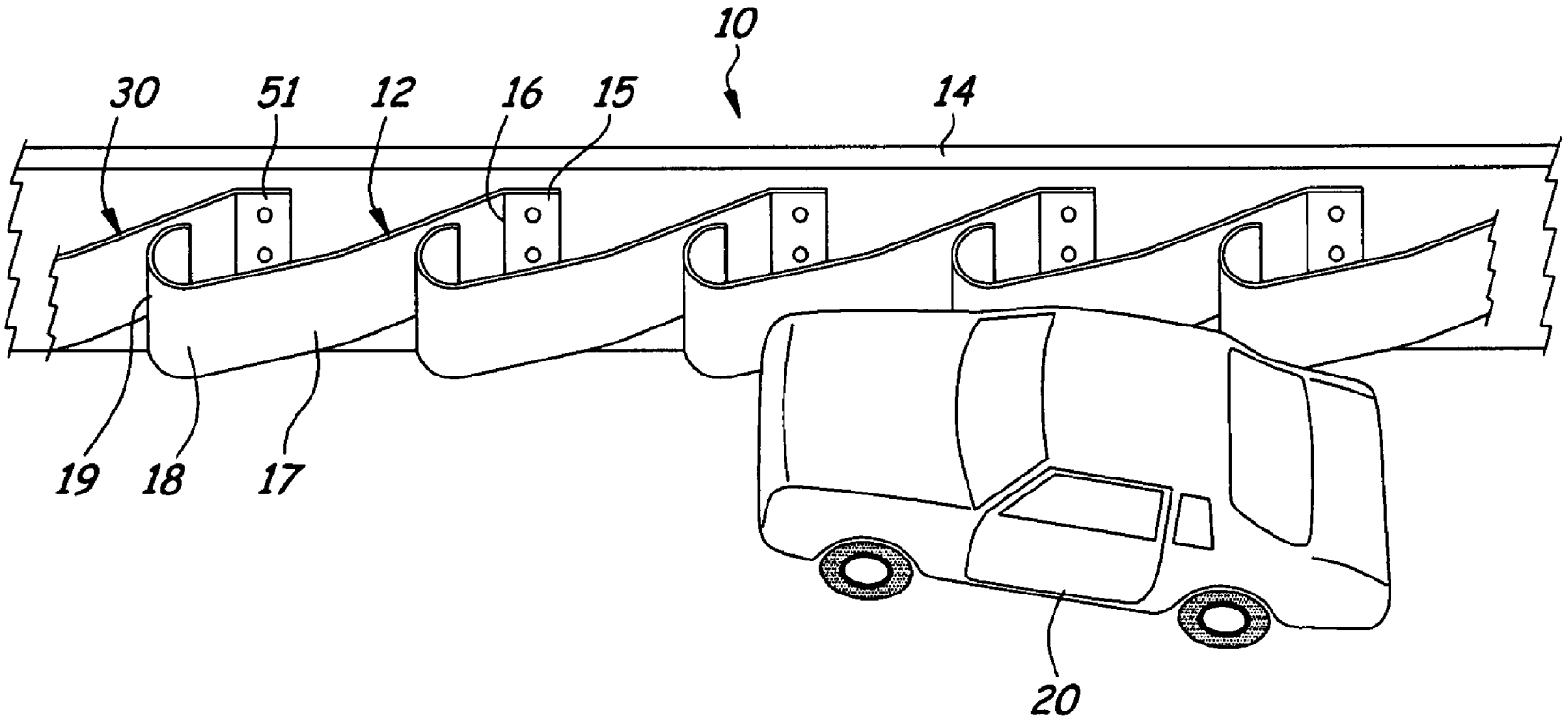
FIG. 1 is a perspective view of the preferred embodiment of the present invention.

The present invention illustrated in FIGS. 1–5 provides an impact barrier system 10 for dissipating the impact force of a vehicle 20 against a retaining wall 14 of a racetrack or highway. The barrier system 10 reduces or prevents damage and injury associated with such impacts, pushes the vehicle 20 away from the retaining wall 14, and also provides a fire safety barrier that may be utilized by drivers after exiting a race car. The impact barrier system 10 of the present invention comprises a plurality of bow-shaped panels 12 attached to a retaining wall 14 in overlapping side-by-side relationship. Each panel 12 has a base 15 at one end which provides a mounting portion whereby base 15 can be reversibly attached to retaining wall 14. In the preferred embodiment, base 15 has a length of about one foot. Base 15 is adapted for reversible connection to the retaining wall 14, and base 15 is generally planer. Base 15 has a bend 16 directing panel 12 away from retaining wall 14. The panel 12 has an opposite end 18 which is curved. In a preferred embodiment, the curved end 18 has a diameter of approximately 18 inches, and the body of each panel 12 has a length of about 10 feet and a height of about 40 inches.

Figure 2:
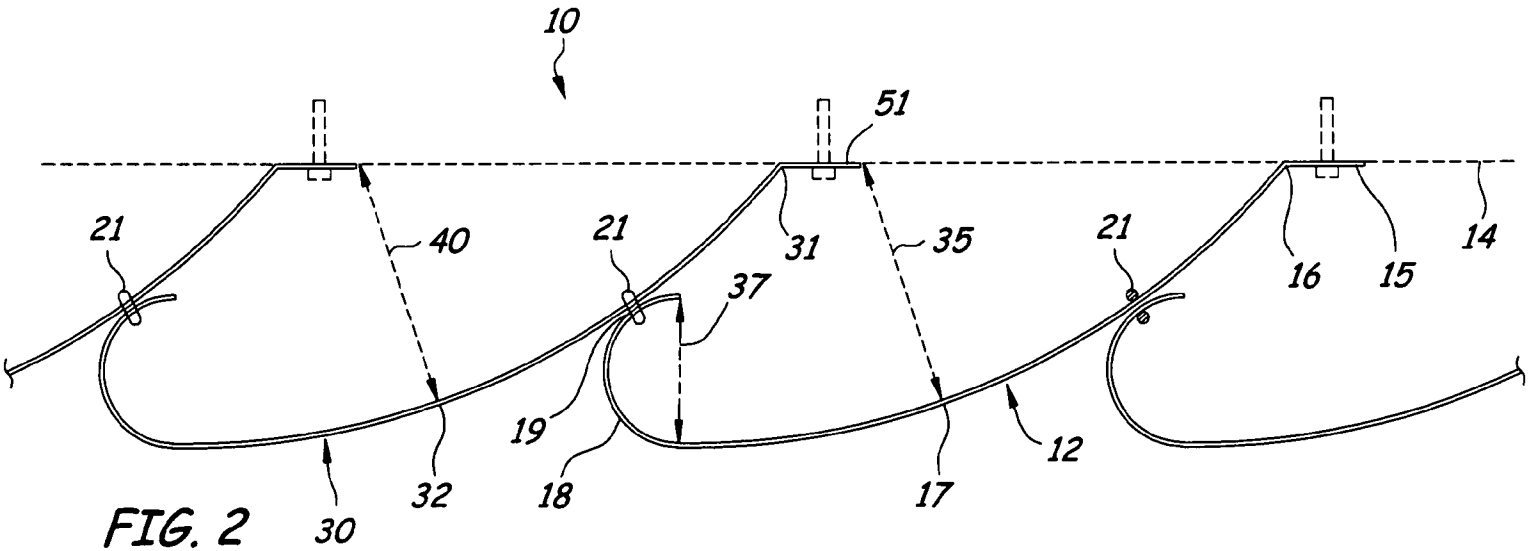
FIG. 2 is a top plan view of the embodiment of FIG. 1 prior to an impact.
Figure 3:
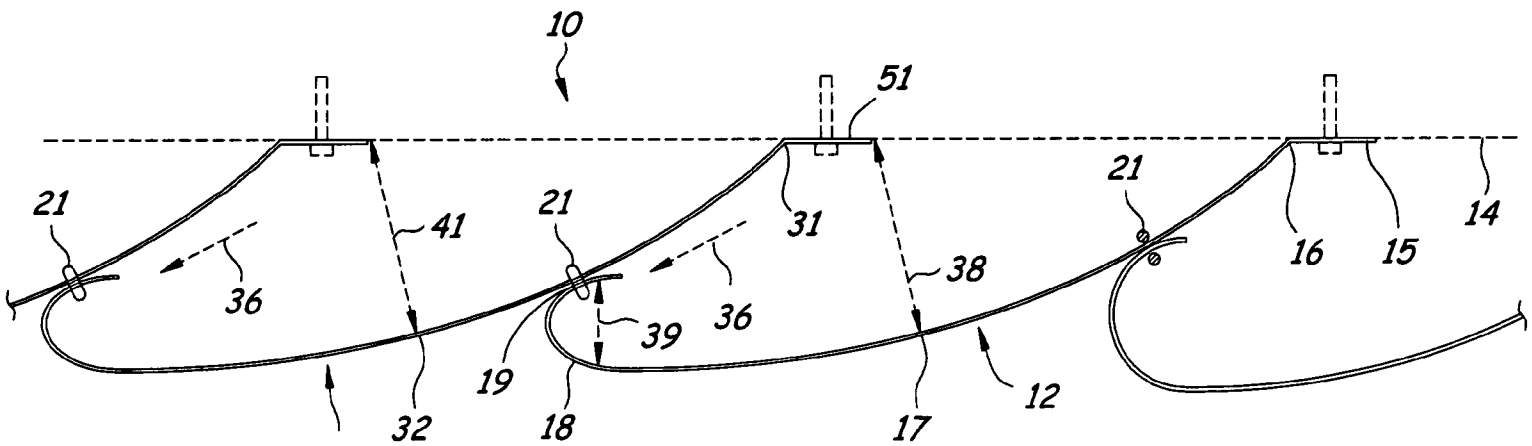
FIG. 3 is a top plan view of the embodiment of FIG. 1 subsequent to an impact.

The impact system 10 is attached to the retaining wall 14 at base 15 in an overlapping configuration that, together with the configuration of the panels, provides a plurality of absorbing mechanisms that work together to absorb the impact of vehicle 20, and that will push vehicle 20 away from retaining wall 14 after impact. These energy absorbing mechanisms or sites are illustrated in FIGS. 2 and 3. The first is a flex point at bend 16, which flexes in a manner similar to a diving board. The second is a middle flex point of panel 12 at the bowed or arced portion 17, which bows outwardly. The third is a flex point at curved end 18, which consists of a generally spring-like compression of curved portion 18 during impact. The fourth is the sliding of the outside 19 of curved end 18 along the body of an adjacent panel 30. The curved end 18 of each panel is preferably attached to the adjacent panel in a manner that holds the panels together yet allows them to slide in relation to each other, such as via a U-shaped bolt 21. The energy absorbing mechanisms are repeated in adjacent panels so that the force of an impact is transferred down multiple panels.

Prior to an impact, as illustrated in FIG. 2, the body of panel 12 is bowed out to a maximum at midpoint 17, producing an arc 35 approximately from about 12 to 36 inches, preferably about 24 inches, relative to wall 14. Curved end 18 has a diameter 37 from about 6 to 30 inches, preferably about 18 inches. During impact, as illustrated in FIG. 3, panel 12 bends at bend 16 and moves inward reducing arc 35 at midpoint 17, shown by arc 38. Consequently, curved end 18 slides along adjacent panel 30, shown by arrow 36. Simultaneously, panel 30 bends inward at bend 31, reducing its arc 40 at midpoint 32 relative to wall 14, as shown by arc 41. As the outside 19 of curved end 18 slides along adjacent panel 30, curved end 18 becomes compressed, reducing its diameter 37, as shown by diameter 39. The inward compression of the panels 12 and 30, and the compression of curved end 18, absorbs the energy of impact, and this energy can then be released by panels 12 and 30 thereby assuming their original shape after impact, similar to a spring. This spring-like recoil effect can push the vehicle 20 away from retaining wall 14 after impact, reducing the likelihood of occupants being trapped in vehicle 20 upon impact. Furthermore, occupants of vehicle 20 can exit the vehicle and position themselves between panel 12 and retaining wall 14 after impact to protect themselves from fire or explosion of vehicle 20.

Figure 4:
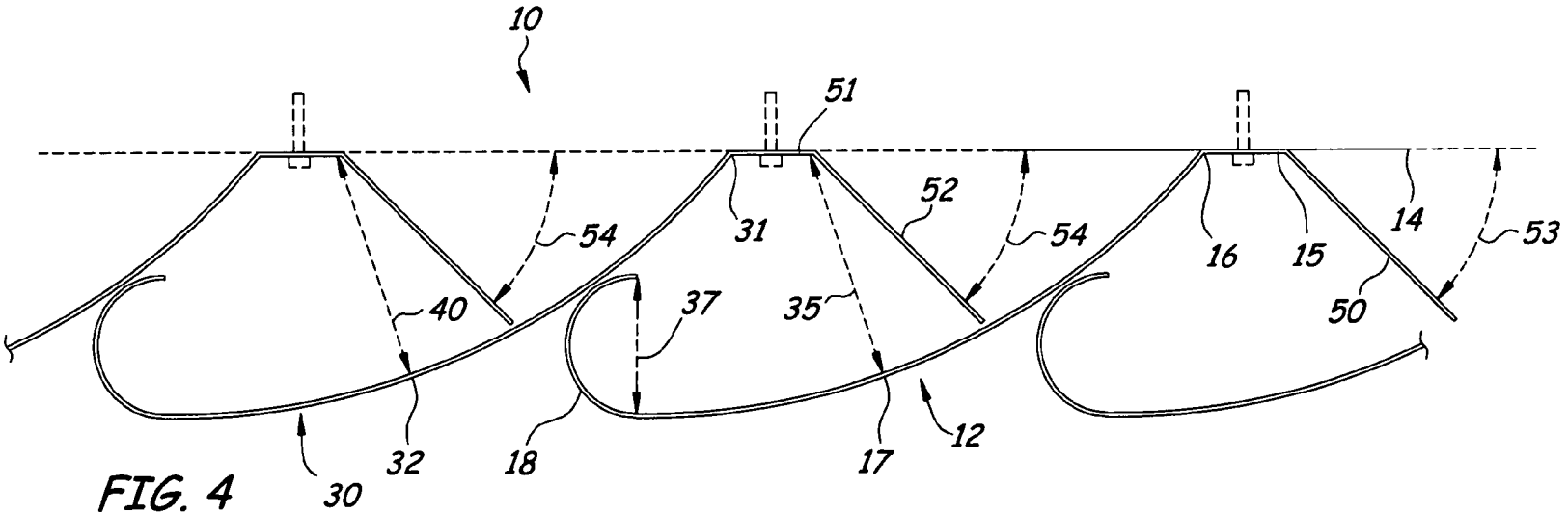
FIG. 4 is a top plan view of an alternate embodiment of the present invention prior to an impact.
Figure 5:
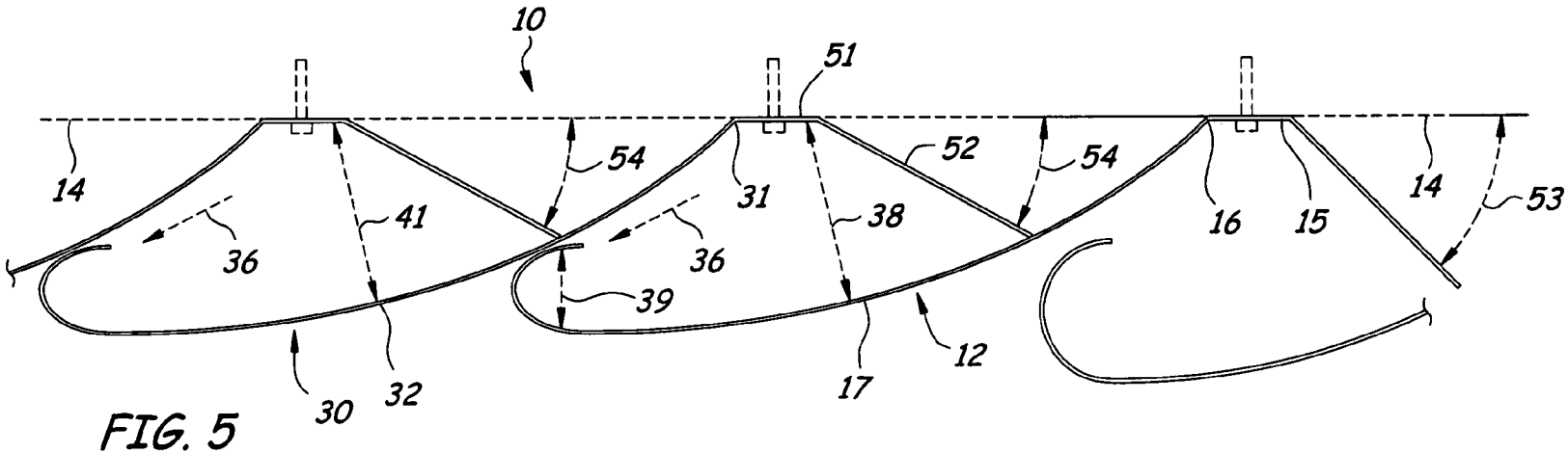
FIG. 5 is a top plan view of the embodiment of FIG. 4 subsequent to an impact.

FIGS. 4 and 5 illustrate an alternate embodiment of the present invention. This embodiment has all the features of that shown in FIGS. 2 and 3, but, in addition, further comprises an extension 50 which extends in the opposite direction of the body portion panel 12, shown as extension 52 in adjacent panel 30. Extensions 50 and 52 extend away from bases 15 and 51, respectively, at angles 53 and 54 which are similar prior to compression (FIG. 4). During compression of panel 12 (FIG. 5), extension 52 is compressed towards wall 14, reducing angle 54, and absorbing impact energy in the process. Thus, these extensions 50 and 52 add further energy-absorbing properties during impact, and further recoil properties during decompression.

Each of the panels of impact system 10 can be constructed in one piece of any suitable material, preferably metal. The height of the panel only needs to extend upward to the bottom edge of the window of a vehicle (e.g. 36–40 inches), although it can extend much higher (e.g. 10 feet). This design prevents blocking or obstruction of the window after impact. Because of the modular nature of the impact system of the present invention, only individual panels which are damaged by impact need to be replaced. Replacement is simple, involving only disconnecting the old panel and connecting a new panel at base 15 to retaining wall 14 by any suitable connecting means well-known in the art. Further, the overlapping design allows the panels to be installed along curved retaining walls and, therefore, the panels can be installed along the entire length of a race track.

It is to be understood that the forms of the invention shown are preferred embodiments thereof and that various changes and modifications may be made therein without departing from the spirit of the invention or scope as defined in the following claims.

What is claimed is:

1. An impact barrier system, comprising:

a. a retaining wall; and b. a plurality of resilient panels mounted to said retaining wall in an overlapping side-by-side relationship, wherein each panel comprises a mounting section reversibly mounted to said retaining wall, a bowed section extending away from said retaining wall and having an external convex surface and an internal concave surface, a bend between said mounting section and said bowed section, and a curved end having a distal portion directed back toward said internal concave surface of said bowed section and an external face for slidably engaging the external convex surface of the bowed section of a subjacent panel.

2. An impact barrier system according to claim 1, wherein each panel further comprises an extension member extending away from said retaining wall in an opposite direction than said bowed section for engaging the internal concave surface of the bowed section of a superjacent panel, and a second bend between said mounting section and said extension member.

3. An impact barrier system according to claim 1, further comprising a plurality of U-shaped bolts for securing adjacent panels together, wherein each U-shaped bolt secures the bowed section of one panel to the curved end of a superjacent panel, wherein said U-shaped bolt allows said one panel and said superjacent panel to slide longitudinally in relation to each other but prevents transverse separation.

4. An impact barrier system according to claim 1, wherein said curved end has a diameter of about 18 inches.

5. An impact barrier system according to claim 1, wherein each panel has a length of about 10 feet and a height of about 40 inches.

6. An impact barrier system, comprising:

a. a retaining wall; and b. a plurality of resilient panels mounted to said retaining wall in an overlapping side-by-side relationship, wherein each panel comprises a planar base reversibly mounted to said retaining wall, a bowed section extending away from said retaining wall and having an external convex surface and an internal concave surface, a bend between said planar base and said bowed section, a curved end having a distal portion directed back toward said internal concave surface of said bowed section and an external face for slidably engaging the external convex surface of the bowed section of a subjacent panel, an extension member extending away from said retaining wall in an opposite direction than said bowed section for engaging the internal concave surface of the bowed section of a superjacent panel, and a second bend between said planar base and said extension member.

7. An impact barrier system according to claim 6, further comprising a plurality of U-shaped bolts for securing adjacent panels together, wherein each U-shaped bolt secures the bowed section of a first panel to the curved end of a second superjacent panel, wherein said U-shaped bolt allows the first panel and the second superjacent panel to slide longitudinally in relation to each other but prevents transverse separation.

8. An impact barrier system according to claim 6, wherein each panel has a length of about 10 feet and a height of about 40 inches.

9. An impact barrier system, comprising:

a. a retaining wall;

b. a plurality of resilient panels mounted to said retaining wall in an overlapping side-by-side relationship, wherein each panel comprises a planar base reversibly mounted to said retaining wall, a bowed section extending away from said retaining wall and having an external convex surface and an internal concave surface, a bend between said planar base and said bowed section, and a curved end having a distal portion directed back toward said internal concave surface of said bowed section and an external face for slidably engaging the external convex surface of the bowed section of a subjacent panel; and c. a plurality of U-shaped bolts for securing adjacent panels together, wherein each U-shaped bolt secures the bowed section of a first panel to the curved end of a second superjacent panel, wherein said U-shaped bolt allows the first panel and the second superjacent panel to slide longitudinally in relation to each other but prevents transverse separation.

10. An impact barrier system according to claim 9, wherein each panel further comprises an extension member extending away from said retaining wall in an opposite direction than said bowed section for engaging the internal concave surface of the bowed section of a superjacent panel, and a second bend between said planar base and said extension member.

11. An impact barrier system according to claim 9, wherein each panel has a length of about 10 feet and a height of about 40 inches.

* * * * *